United States Patent [19]

McKenzie

[11] 4,046,269

[45] Sept. 6, 1977

[54] CONTROL ASSEMBLY FOR REFUSE VEHICLE

[75] Inventor: Roland W. McKenzie, Culpeper, Va.

[73] Assignee: City Tank Corporation, Culpeper, Va.

[21] Appl. No.: 732,436

[22] Filed: Oct. 14, 1976

[51] Int. Cl.[2] ..... B65F 3/00

[52] U.S. Cl. ..... 214/83.3

[58] Field of Search ..... 214/83.3, 503

[56] References Cited

U.S. PATENT DOCUMENTS

| | | | |
|---|---|---|---|
| 3,822,797 | 7/1974 | McKenzie et al. | 214/83.3 |
| 3,917,085 | 11/1975 | McKenzie | 214/83.3 |

*Primary Examiner*—Robert G. Sheridan

*Attorney, Agent, or Firm*—Mason, Fenwick & Lawrence

[57] ABSTRACT

A mechanism for operating a control valve mounted on a support structure and provided with slidable spools generally including a first control rod mounted on the support structure for rectilinear motion along its axis, a second control rod mounted on the support structure for rectilinear motion along its axis, means operatively interconnecting the first control rod and a first valve spool for translating the rectilinear movement of the first control rod to rectilinear movement of the first valve spool, means operatively interconnecting the second control rod to a second valve spool for translating the rectilinear movement of the second control rod to rectilinear movement of the second valve spool, a control actuator mounted on said support structure for pivotal movement about a first axis and for pivotal movement about a second axis generally perpendicular to said first axis, and means operatively interconnecting the control handle and the first control rod for translating the pivotal movement of the control handle about the first axis to rectilinear movement of the first control rod and means operatively interconnecting the control handle and the second control rod for translating the pivotal movement of the control handle about the second axis to rectilinear movement of the second control rod.

10 Claims, 9 Drawing Figures

Fig-3
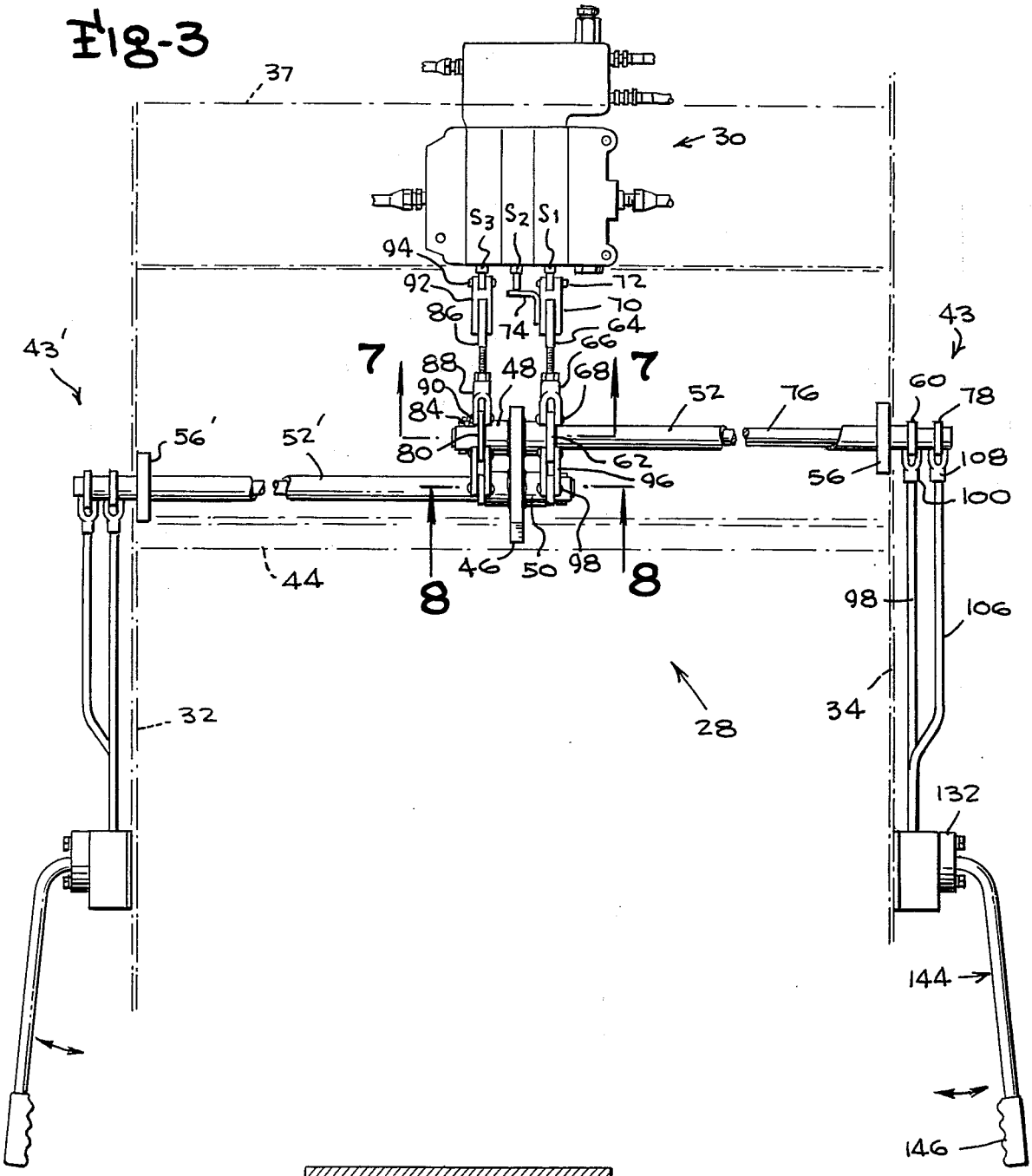
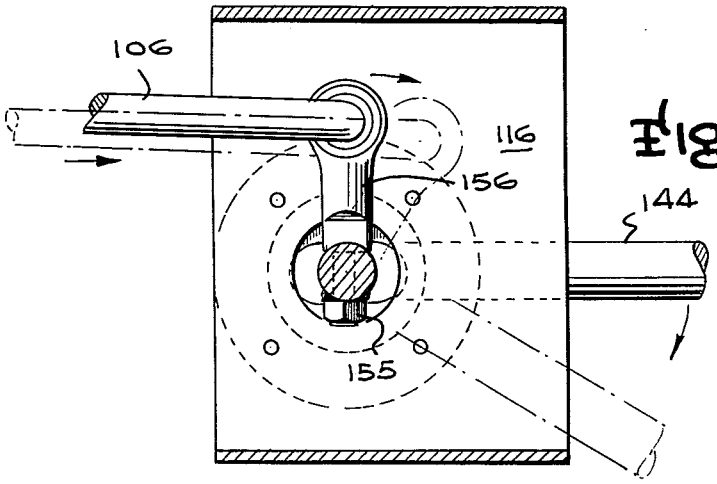
Fig-4

CONTROL ASSEMBLY FOR REFUSE VEHICLE

This invention relates to a valve operating mechanism, and more particularly to a mechanism for operating a control valve provided with two spools adapted to be shifted axially, thereby controlling the flow of fluid under pressure in a fluid operated system. The invention further contemplates a mechanism utilizing a single control handle for operating a control valve of a fluid control system for a refuse transferring and compacting mechanism in a refuse collection vehicle.

In the prior art, there has developed a refuse collection vehicle which generally includes a refuse storing body mountable on a truck chassis, a refuse receiving hopper mounted on the rear end of the storage body and communicating internally with the storage body, and a mechanism mounted in a refuse receiving hopper for transferring refuse deposited in the hopper into the storage body and compacting the refuse therein. The typical mechanism for transferring the refuse from the refuse receiving hopper to the refuse storing body and compacting the refuse within the storage body, consists of a fluid actuated, rectilinear moveable carrier unit, a fluid actuated packer panel pivotally mounted on the carrier unit in a fluid system for controlling the movements of the carrier unit and packer panel. In such a mechanism, the packer panel is adapted to pivot relative to the carrier unit to provide a refuse sweeping action which includes the crushing of bulky refuse, in the carrier unit is adapted to reciprocate along its line of travel to position the packer panel over refuse charged into the receiving hopper preceding the sweeping action of the packer panel and move the packer panel while in a downwardly disposed position for transferring the refuse forwardly into the storage body and compacting such refuse in the storage body. The movements of such packer panels and carriers usually are effected by means of fluid actuated pistons and cylinder assemblies which are supplied with fluid under pressure by a fluid system to operate such components in a predetermined sequence. The sequence of operations of such components usually is controlled by a control valve which functions to supply fluid under pressure sequentially to selective sides of the actuating piston and cylinder assemblies for the packer panels and carriers.

In such vehicles, there is usally provided a mechanism for operating the control valve for the fluid system of the refuse transferring and compacting mechanism, which normally is operated by personnel engaged in either manually or mechanically charging refuse into the refuse receiving hoppers from refuse containers located on the presmises of residences, commercial establishments, industrial firms and other refuse producing concerns. It has been found, however, that conventional mechanisms in the prior art for operating control valves of the type described, have not been entirely satisfactory from the standpoint of durability of construction, simplicity of manufacture and ease of operation by the operating personnel. In particular, the previously known control mechanisms have not provided a durable control mechanism operable by a single control handle to provide a simple, high performance control mechanism.

Accordingly, it is the principal object of the present invention to provide a novel mechanism for operating a control valve.

Another object of the present invention is to provide a novel mechanism for operating a control valve having slidable spools for controlling the flow of fluid under pressure therethrough.

A further object of the present invention is to provide a novel mechanism for operating a control valve in a fluid system.

A still further object of the present invention is to provide a novel mechanism for operating a control valve of a fluid system adapted to operate a mechanism consisting of fluid actuated components of the type found on a refuse collection vehicle.

Another object of the present invention is to provide a novel mechanism utilizing a single control handle for operating a control valve utilized in a fluid system for operating a refuse transferring and compacting mechanism of a refuse collection vehicle.

A further object of the present invention is to provide a novel mechanism on a refuse collection vehicle for manually operating a control valve utilized in a fluid system for supplying fluid under pressure to fluid actuated components of a working mechanism which is very durable and maintenance-free over the life of the mechanism.

A still further object of the present invention is to provide a novel mechanism having a single control handle for operating a control valve having two valve spools utilized in a fluid system adapted to cycle a mechanism for transferring and compacting refuse in a refuse collection vehicle.

Another object of the present invention is to provide a novel, single handled mechanism for manually operating a control valve of a mechanism for transferring and compacting refuse in a refuse collection vehicle which is simple in construction and operation, relatively inexpensive to manufacture and service, effective in performance and safe in operation.

Other objects and advantages of the present invention will become more apparent to those persons having ordinary skill in the art to which the present invention pertains, from the following description taken in conjunction with the accompanying drawings wherein.

FIG. 3 is a fragmentary rear elevational view illustrating the embodiment of the invention mounted on the refuse receiving hopper disclosed in FIGS. 1 and 2;

FIG. 4 is an enlarged cross-sectional view taken along line 4—4 of FIG. 5;

Figure 1:
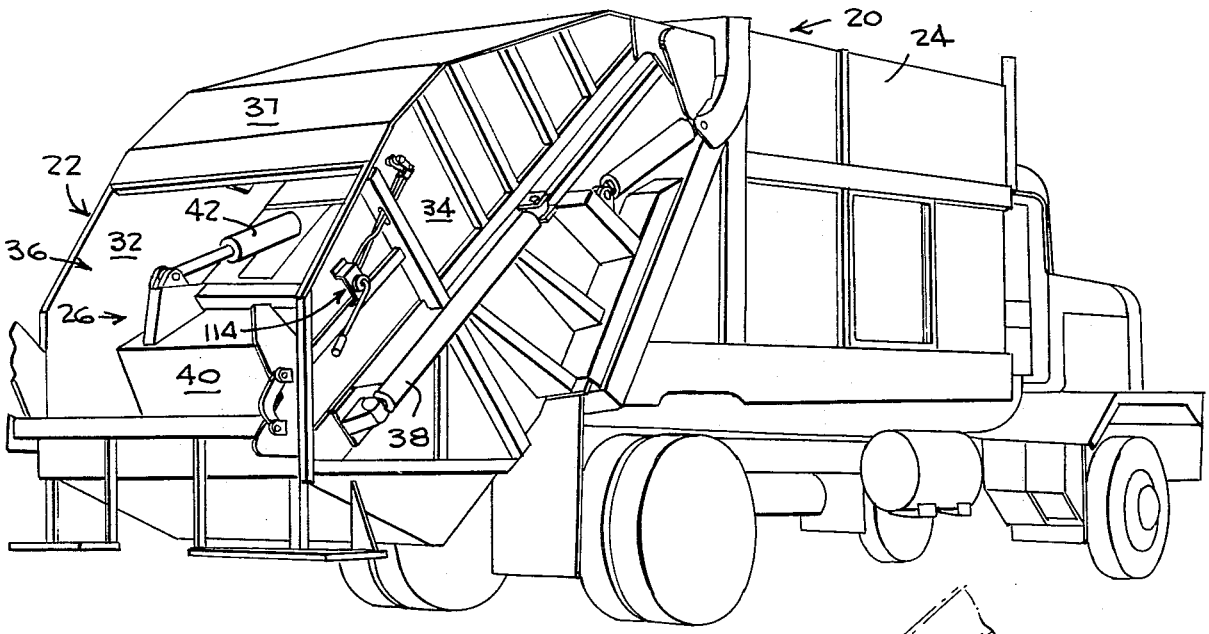
FIG. 1 is a perspective view of a refuse collection vehicle, with an embodiment of the present invention mounted thereon.

Referring to FIGS. 1, 2, 3 and 9 there is illustrated a refuse collection vehicle 20 having a refuse receiving hopper 22 mounted on the rear end of a refuse storing container 24 rigidly secured on a truck chassis, a mechanism 26 mounted within the receiving hopper for transferring refuse charged into the receiving hopper and into the storage body for compacting the refuse therein, a fluid system for operating the transfer mechanism 26, and a bi-directional control mechanism 28 mounted on the receiving hopper for operating a control valve 30 of the fluid system.

Figure 2:
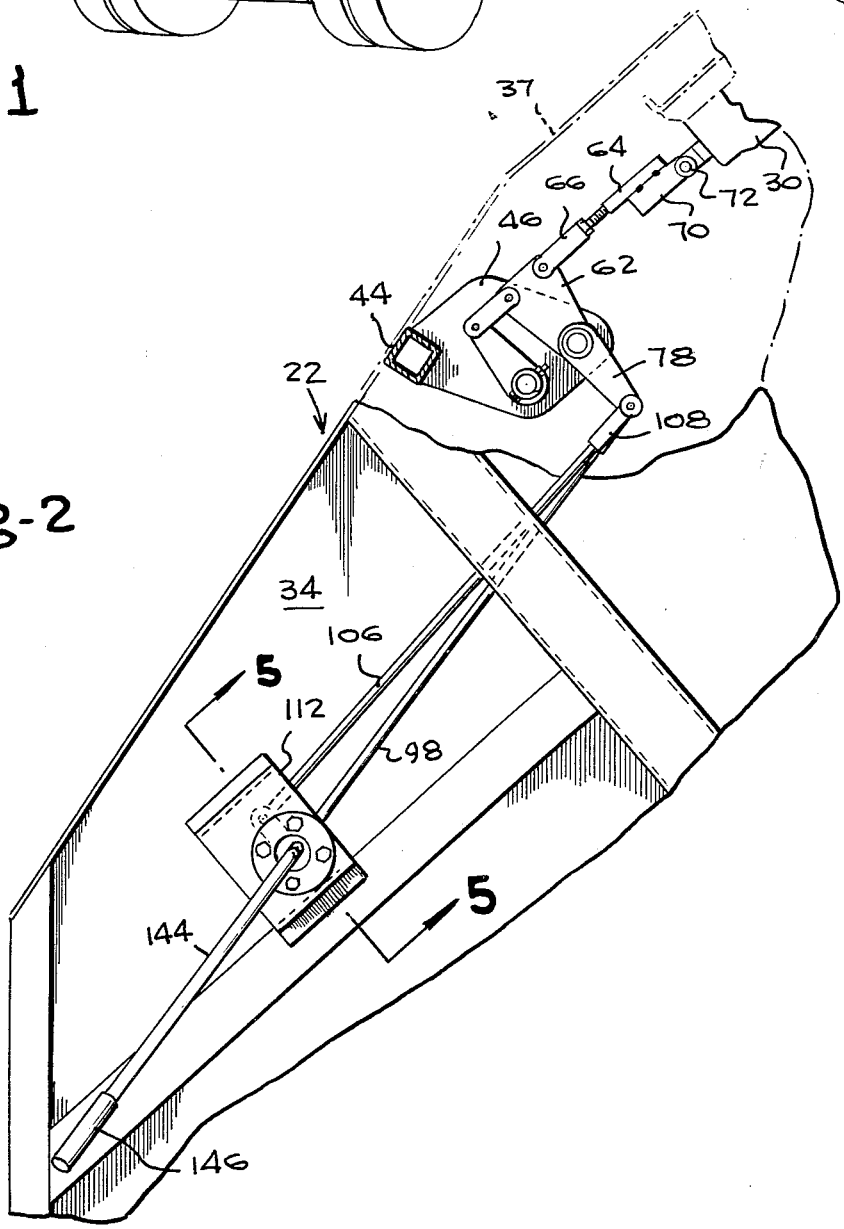
FIG. 2 is a fragmentary side elevational view of the refuse hopper and the embodiment of the present invention shown in FIG. 1.

Referring to FIGS. 1 through 3, the refuse receiving hopper 22 includes a pair of side walls 32 and 34 forming a portion of a rearwardly disposed opening 36, through which refuse may be charged into the interior of the receiving hopper.

The transfer mechanism 26 is of conventional construction and includes a pair of fluid actuated piston and cylinder assemblies 38, as indicated in FIG. 1, which are utilized to move a packer panel 40 through the desired transfer and packing cycle in a conventional manner. A fluid actuated piston and cylinder assembly 42 is actuated to pivot the packer panel 40 to assist in the transfer cycle. Such a system is disclosed in U.S. Pat. No. 3,822,797 to McKenzie et al.

The control valve 30 includes valve spools $S_1$, $S_2$ and $S_3$ which are shifted by the control mechanism 28 as desired by operating personnel to achieve the desired sequencing of hydraulic components including the piston and cylinder assemblies 38 and 42 and to achieve automatic cycling of the transfer mechanism 26 when the spools $S_1$, $S_2$ and $S_3$ of a control valve 30 are shifted inwardly. The valves are shifted outwardly to interrupt the cycling of the transfer mechanism 26 which permits the immediate release of any limbs of operators which might be caught between the packer panel 40 and the walls of the hopper 22.

Figure 9:
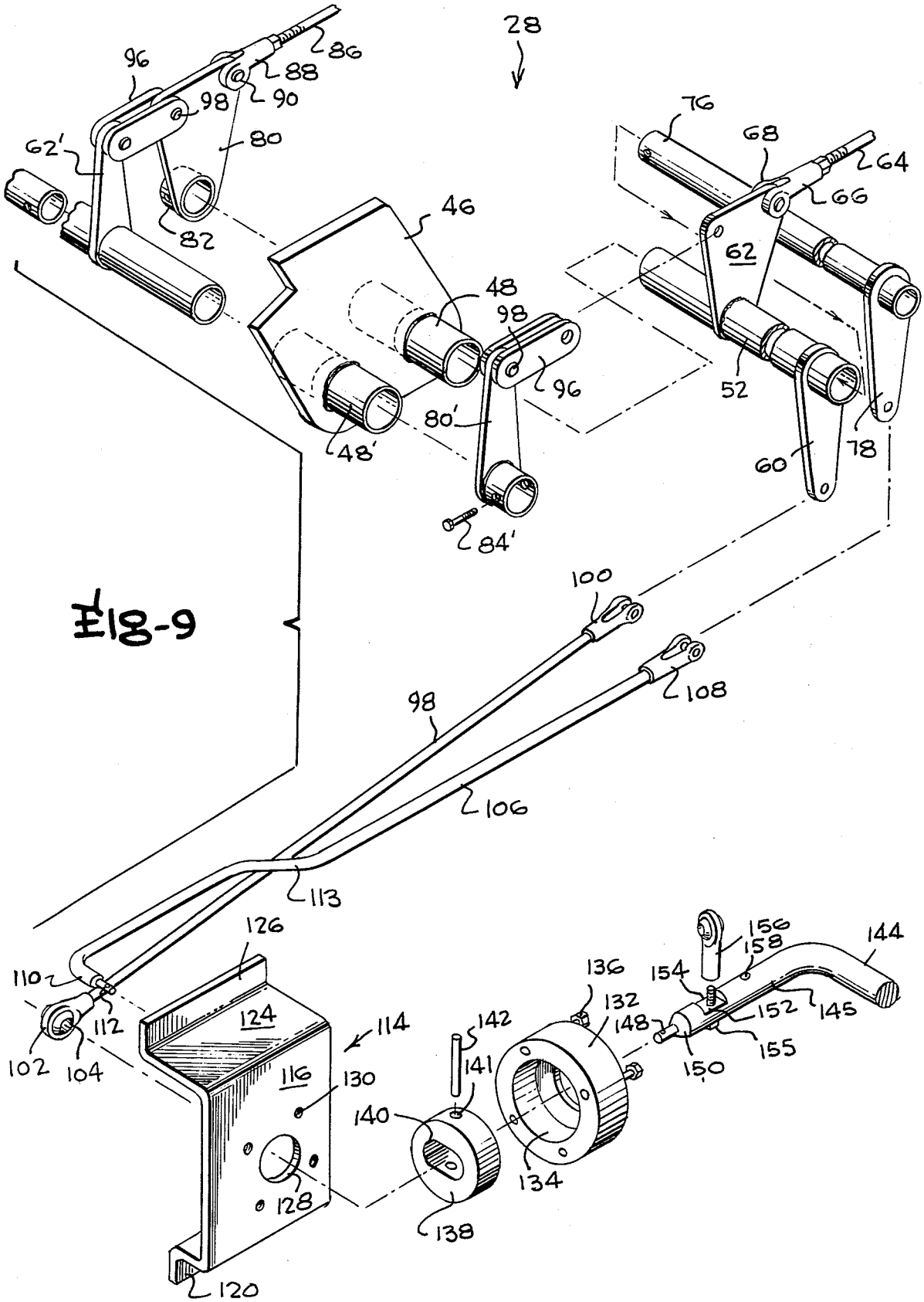
FIG. 9 is an exploded view of the control mechanism according to the present invention.

The control mechanism 28 is adapted to be supported on a top wall section 27 of the hopper adjacent the control valve 30 which is also mounted on the underside of the top wall section 37 as best illustrated in FIG. 2. Referring particularly to FIGS. 3 and 9, the control mechanism 28 includes a right hand control assembly 43 and a left hand control assembly 43' to permit operation of the mechanism from either side of the refuse collection truck. Since both control assemblies are nearly identical, only the differences will be discussed with similar components being identified with the prime notation.

Figure 7:
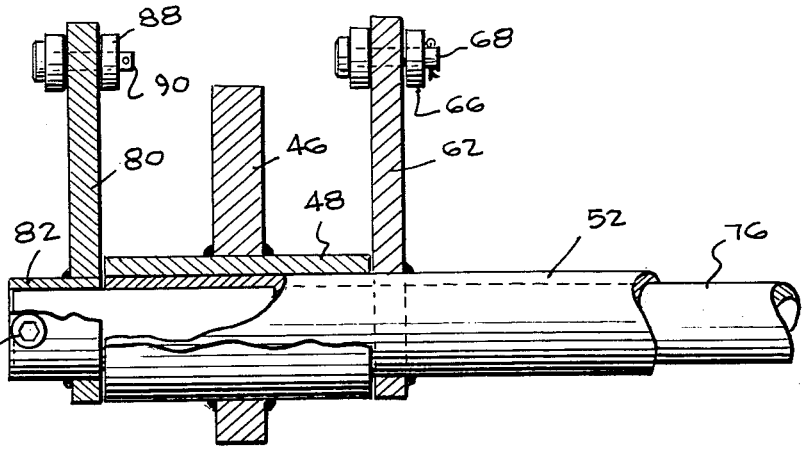
FIG. 7 is an enlarged cross-sectional view taken along line 7—7 in FIG. 3.
Figure 8:
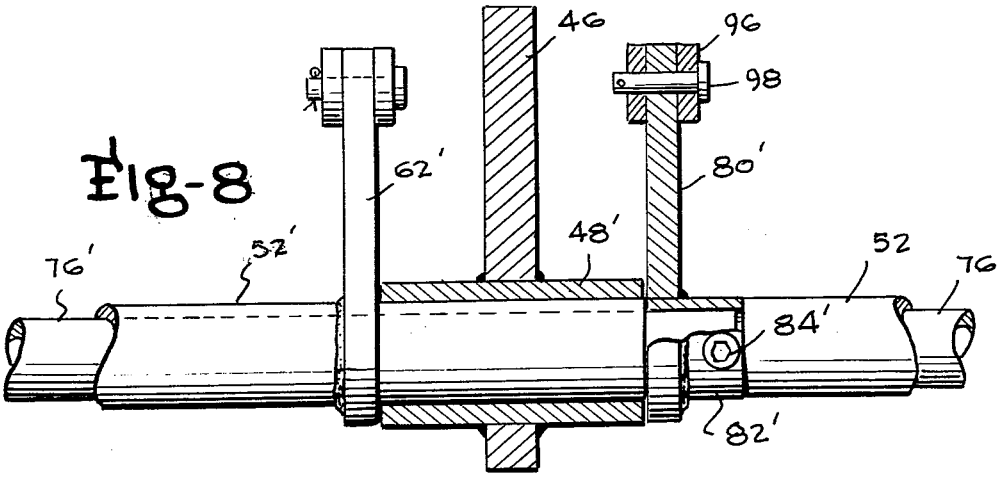
FIG. 8 is an enlarged a cross-sectional view taken along line 8—8 in FIG. 3.

The control mechanism includes a rectangular tube 44 disposed in substantially longitudinal alignment with the control valve 30 and fixed at its ends to hopper side wall 32 and 34. A support plate 46 is rigidly mounted at the center of the rectangular tube 44 and is in general alignment with the center line of the hopper as shown in FIG. 3. Mounted on the support plate 46 are a pair of longitudinally disposed bushings 48 and 48' as best shown in FIGS. 3, 7 and 8. A first control tube 52 and a second control tube 52' are journaled in the bushings 48 and 48' respectively and also in bearing blocks 56 and 56' mounted on the hopper side walls 32 and 34 as shown in FIG. 3.

A first arm 60 is radially disposed on the first control tube 52 and a second arm 62 is diametrically opposed to said first arm and tranversely spaced apart therefrom to form a first bell crank with said first arm positioned outwardly of the hopper side wall 34 as shown in FIG. 3. The second arm 62 is operatively connected to spools $S_1$ and $S_2$ of the control valve 30 by means of a connecting link 64 provided at its rearward end with a clevis 66 pivotally connected to the first arm 60 by means of a connecting pin 68 and provided at its forward end with a clevis 70, pivotally connected to spools $S_1$ by means of a connecting pin 72. Clevis 70 includes an L-shaped bracket 74 attached thereto which engages spool $S_2$ as shown in FIG. 3.

A second bell crank is formed by a connecting shaft 76 which is journaled inside the first control tube 52 as shown in FIGS. 3, 7 and 9 and extends beyond the ends of the first control tube 52. A first lever 78 is fixedly attached to the outer end of the shaft 76 and a second lever 80 is removably attached to the inner end of the shaft by a mounting bushing 82 fixedly attached to the second lever 80 and positionable over the inner end of the shaft and attachable thereto by a mounting bolt 84 as shown in FIG. 7.

The first and second levers are diametrically opposed thereby forming a second bell crank which is rotatable relative to the first bell crank formed on a first control tube 52. The second lever 80 is operatively connected to spool $S_3$ of the control valve 30 by means of a connecting link 86 provided at its rearward end with a clevis 88 pivotally connected to the second arm portion 80 by means of a connecting pin 90 and provided at its forward end with a clevis 92 pivotally connected to spool $S_3$ by means of a connecting pin 94 as shown in FIG. 3.

Dual control of the control valve 30 is provided by the first control assembly 43 positioned on the right hand portion of the hopper and the second control assembly 43' positioned on the left hand portion of the hopper assembly as best shown in FIG. 3. The second control assembly 43' is similar to the first control assembly 43. However, the first arm 62' and second lever 80' are operatively connected to the second lever 80 and first arm 62 respectively by connecting links 96 pivotally connected to the arms and levers by pins 98 as best shown in FIG. 9.

Figure 5:
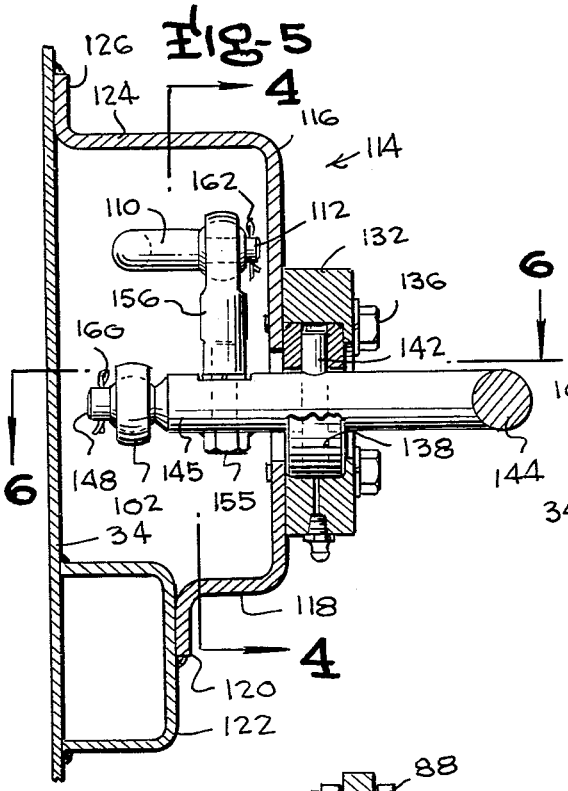
FIG. 5 is an enlarged cross-sectional view taken along line 5—5 in FIG. 2.

Rotation of the first arm 60 is accomplished through a first control rod 98 provided at its forward end with a clevis 100 pivotally connected to the first arm 60 by a pin and provided at its rearward end with a spherical bearing assembly 102 having a bore 104 therethrough. A second control rod 106 is provided at its forward end with a clevis 108 pivotally connected to the first lever 78 and having a generally perpendicular leg 110 formed at the rearward end thereof which has a reduced diameter portion 112 at the free end thereof as best shown in FIGS. 5 and 9 with a cotter pin hole passing therethrough. The second control rod 106 includes an offset portion 113, as shown in FIG. 9, to provide desired clearance.

Mounted on the side wall 34, as shown in FIGS. 1 and 2, is a control assembly bracket 114 having a top wall section 116, a first downwardly projecting wall section 118 with a foot section 120 which is welded to a U-channel fixed to the side wall 34, and a second inwardly projecting side wall 124 having a foot section 126 welded to the hopper side wall. As best shown in FIG. 9, the top wall section 116 has a clearance hole 128 with four circumferentially spaced apart threaded bores 130 positioned around the clearance hole. Mounted on the control handle bracket 114 is a bearing block 132 having a recessed bore 134 therein of diameter larger than the clearance hole 128 in the handle bracket. The bearing block has bolt holes extending axially therethrough and registrable with the threaded bores 130 on the handle bracket 144 to permit bolts 136 to be threaded therein to fixedly attach the bearing block 132 to the handle bracket.

Journaled in the recessed bore 134 of the bearing block is a bearing 138 having an elongated slot 140 in axial alignment with the recessed bore 134 and registrable with the clearance hole 129 in the handle bracket 114. A pivot pin 142 is inserted into a bore 141 passing through the bearing 138 perpendicular to the axis of the elongated slot 140 and centrally positioned with respect to the slot.

Manual control to the control mechanism is applied by a control handle 144 formed of an elongated rod having a hand grip 146 at one end thereof. The opposite end of the control handle is bent at generally right angles to the axis of the rod to form a leg 145 with the end thereof having a reduced diameter section 148 extending beyond a shoulder 150. Positioned near the shoulder 150 on handle leg 145 is a groove 152 which has a bottom surface 154 generally parallel to the handle 144.

Operatively interconnecting control handle 144 and the second control rod 106 is a ball joint rod end 156 having a lever portion seatable against the bottom surface of the groove 152 and retainable thereon by a bolt fastener 155 extending upwardly through the handle leg 145 to engage a threaded bore in the lower end of the ball joint rod end 156. The upper end of the ball joint rod end 156 includes a spherical bearing 157 with a bore therethrough to receive the reduced diameter portions 112 of the second control rod 106. Positioned adjacent the ball joint rod end 156 is a pivot pin hole 158, as shown in FIG. 9, extending through the handle parallel to the center line of the ball joint rod end and registrable with the pivot pin 142 when the pivot pin is inserted through the mounting hole 141 in the bearing 138 as shown in FIGS. 5, 6 and 9.

Figure 6:
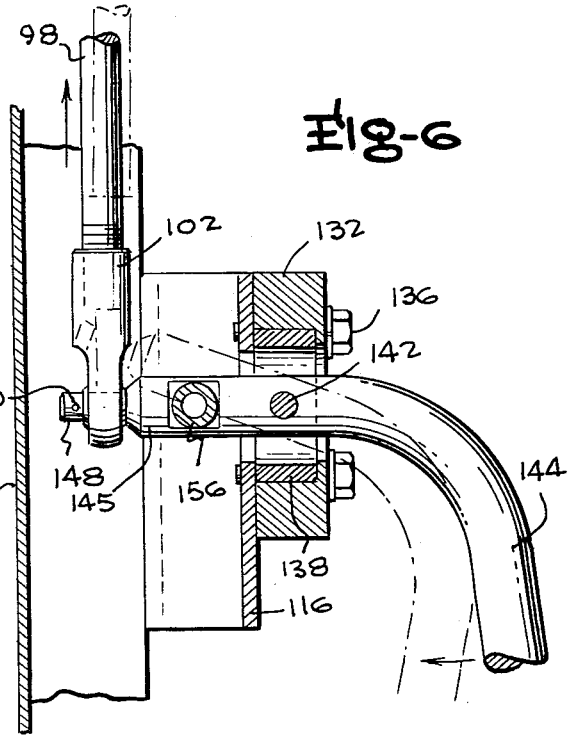
FIG. 6 is a cross-sectional view taken along line 6—6 in FIG. 5.

The first control rod 98 is operatively connected to the control handle 144 by inserting the reduced diameter portion 148 on the handle leg 145 into the bore 104 on the spherical bearing assembly 102 and retaining it thereon with a cotter pin 160 as shown in FIG. 5 and 6. Since the ball joint rod end 156 is removably attached to the handle by the bolt fastener 156 it may be attached after the pivot pin 142 has been inserted through the bearing block 132. The bearing block may then be attached to the top wall section 116 of the control bracket 114 by bolts 136 as shown in FIGS. 5 and 6. As best shown in FIG. 5, the second control rod 106 is operatively connected to the ball joint rod end 156 by inserting the reduced diameter end 112 through the bore of the spherical bearing and pivotally retaining it therein by insertion of a cotter pin 162 in the end of the rod.

It thus will be seen that the control linkage of the present invention provides a bi-directional handle to permit relatively independent operation of valve spools $S_1$ and $S_3$ through the selection of the appropriate direction of rotation of the handle 144 by the operator who grasps the handle grip 146. The first direction of rotation which is permitted by the embodiment shown in the various figures would be toward or away from the hopper side wall 32 which causes the handle 144 to rotate about pivot pin 142. This movement, in turn, causes the first control link 98 to reciprocate either forwardly or backwardly, as indicated in FIG. 6, as the handle 144 is moved between the positions thereindicated. Whenever the first control link 98 is moved, it will cause the first arm 60 on the first control tube 52 to rotate about the center of bushing 48 mounted on support plate 46. This motion in turn causes the second arm 62 to rotate and connecting link 64 to reciprocate which moves spools $S_1$ and $S_2$ inwardly or outwardly depending on the movement of the handle 144 as indicated in FIG. 3. Hydraulic fluid will then be provided to the fluid control system of the refuse collection vehicle in the desired manner.

The second direction of rotation of the handle 144, which is permitted by the present invention, is by moving the control handle up or down as indicated in FIG. 4 which causes bearing 138 to rotate within bearing block 132 thereby causing the ball joint rod end 156 to be rotated forwardly or backwardly as indicated in FIG. 4. This movement causes the second control link 106 to reciprocate in a forwardly or backwardly direction. Clevis 108 at the forward end of the second control link 106 causes the first lever 78 shaft 76 and second lever 80 to rotate about the center line of the bushing 48 mounted on support plate 46. The motion of the second lever 80 is transmitted to the valve spool $S_3$ by the connecting link 86 as shown in FIG. 3. The second control assembly 43' operates in an identical manner to the first control assembly 43 with its bi-directional control being transmitted to the valve spools $S_1$, $S_2$ and $S_3$ by connecting links 96 which interconnect the first arm 62' and first lever 80' with the second lever 80 and first arm 62 respectively, as indicated in FIG. 9, thereby permitting operation of the control valve 30 from either side of the hopper 26.

From the foregoing detailed description, it will be evident that there are a number of changes, adaptions and modifications of the present invention which come within the province of those persons skilled in the art. However, it is intended that all such variations not departing from the spirit of the invention be considered as within the scope thereof as limited solely by the appended claims.

I claim:

1. In a refuse collection vehicle including a refuse storage body, a refuse receiving hopper mounted on said refuse storage body and communicating interiorly with said storage body and a fluid actuated mechanism mounted in said refuse receiving hopper for transferring refuse deposited in said hopper into said storage body and compacting the refuse therein, said fluid actuating mechanism including a control valve having a first slidable spool and a second slidable spool, a control mechanism for operating said control valve comprising a first control rod mounted on the refuse hopper for rectilinear motion along its axis, a second control rod mounted on the refuse hopper support structure for rectilinear motion along its axis, means operatively interconnecting the first control rod and the first valve spool for translating the rectilinear movement of the first control rod to rectilinear movement of the first valve spool, means operatively interconnecting the second control rod to the second valve spool for translating the rectilinear movment of the second control rod to rectilinear movement of the second valve spool, a control handle mounted on said hopper, means for pivotal movement of said control handle about a first axis and means for a pivotal movement of said control handle about a second axis generally perpendicular to said first axis, and means operatively interconnecting the control handle and the first control rod for translating the pivotal movement of the control handle about the first axis to rectilinear movement of the first control rod and means operatively interconnecting the control handle and the second control rod for translating the pivotal movement of the control handle about the second axis to rectilinear movement of the second control rod.

2. The mechanism according to claim 1 wherein the axes of said control rods are disposed transversely and substantially parallel.

3. The control mechanism according to claim 1 wherein said means operatively interconnecting the control handle and the first control rod for translating the pivotal movement of the control handle about said first axis to rectilinear movement of the first control rod includes a lever arm rigidly connected to said control handle and having a free end thereof eccentrically disposed with respect to said first axis and pivotally connected to said first control rod whereby upon pivoting said control handle about said first axis, said lever arm will be caused to pivot correspondingly to move said first control rod rectilinearly along its axis.

4. The control mechanism according to claim 1 wherein said means operatively interconnecting the control handle and the second control rod for translating the pivotal movement of the control handle about said second axis to rectilinear movement of the second control rod includes a lever arm rigidly connected to said control handle and having a free end thereof eccentrically disposed with respect to said second axis and pivotally connected to said second control end whereby upon pivoting said control handle about said second axis, said lever arm will be caused to pivot correspondingly to move said first control rod rectilinearly along its axis.

5. The mechanism according to claim 1 wherein said means operatively interconnecting said first control rod and said first valve spool for translating the rectilinear movement of said first control rod to rectilinear movement of said first valve spool comprises a bell crank having a first arm portion pivotally connected to said first control rod, and a link pivotally connected at one end to a second arm of said bell crank and operatively connected at the opposite end thereof to said first valve spool.

6. The mechanism according to claim 1 wherein said means operatively connecting said second control rod to said second valve for translating the rotational movement of said second control rod to rectilinear movement of said second valve spool comprises a lever arm rigidly connected to said second control rod and a connecting link pivotally connected at one end to said lever arm and operatively connected at the opposite end thereof to said second valve spool.

7. The control mechanism of claim 1 wherein the means for pivotal movement of said control handle about said first axis and said means for pivotal movement of said control handle about a second axis generally perpendicular to said first axis, includes a bearing journaled on said vehicle with an axis of rotation generally colinear with said first axis and a pivotal support on said bearing with an axis of rotation generally perpendicular to the axis of rotation of said bearing, said control arm mounted on said pivotal support to permit rotation of said control arm about said second axis thereby permitting the control handle to rotate about the axis of the bearing and about the axis of the pivotal support.

8. A mechanism according to claim 7 wherein said means operatively interconnecting said first control rod and said first valve spool for translating the rectilinear movement of said first control rod to rectilinear movement of said first valve spool comprises a first bell crank mounted on said vehicle having a first arm portion pivotally connected to said first control rod, and a connecting link pivotally connected at one end thereof to a second arm of said first bell crank and operatively connected at the opposite end thereof to said first valve spool.

9. The mechanism according to claim 7 wherein said means operatively interconnecting said second control rod and said second valve spool for translating the rectilinear movement of said second control rod to rectilinear movement of said second valve spool comprises a second bell crank mounted on said hopper and having a first arm portion pivotally connected to said second control rod, and a connecting link pivotally connected at one end thereof to a second arm of said second bell crank and operatively connected at the opposite end thereof to said second valve spool.

10. The mechanism according to claim 8 wherein said means operatively interconnecting said second control rod and said second valve spool for translating the rectilinear movement of said second control rod to rectilinear movement of said second valve spool comprises a second bell crank mounted on said hopper and having a first arm portion pivotally connected to said second control rod, and a connecting link pivotally connected to one end thereof to a second arm of said second bell crank and operatively connected to the opposite end thereof to said second valve spool and wherein said first bell crank includes a control tube journal on the hopper with the first arm portion and the second arm portion attached to the control tube and said second bell crank includes a shaft journaled within said control tube and extending beyond the ends of said tube with said first arm portions and said second arm portions of said second bell crank attached to said shaft at opposite ends of said control tube.

* * * * *